United States Patent [19]

Off et al.

[11] 4,026,172

[45] May 31, 1977

[54] BELT LOOP TRIMMING APPARATUS

[75] Inventors: Joseph W. A. Off, Irving; Judson Horace Early, Dallas, both of Tex.

[73] Assignee: Hagger Company, Dallas, Tex.

[22] Filed: Mar. 17, 1975

[21] Appl. No.: 559,340

[52] U.S. Cl. ..... 83/106; 83/208; 83/365; 83/369; 83/371

[51] Int. Cl.[2] ..... B26D 7/06; B26D 5/34

[58] Field of Search ..... 83/106, 208, 365, 369, 83/371

[56] References Cited

UNITED STATES PATENTS

| | | | |
|---|---|---|---|
| 3,169,428 | 2/1965 | Owen | 83/106 X |
| 3,407,690 | 10/1968 | Stanley | 83/371 X |
| 3,523,392 | 8/1970 | Carl | 83/208 X |
| 3,661,106 | 5/1972 | Huddelston | 83/365 X |
| 3,760,669 | 9/1973 | Rosenthal et al. | 83/208 X |
| 3,763,728 | 10/1973 | Blackman | 83/371 X |
| 3,793,915 | 2/1974 | Hujer | 83/208 X |
| 3,822,624 | 7/1974 | Shoji et al. | 83/208 |

*Primary Examiner*—Willie G. Abercrombie
*Attorney, Agent, or Firm*—Richards, Harris & Medlock

[57] ABSTRACT

Disclosed is an improved apparatus for automatically cutting belt loops and removing splices from a loop string material. The apparatus has an input portion for directing loop string material into the apparatus and storing a quantity of the material with a dancer roller. The loop string leaves the input portion and is transported by first and second driven rollers. A splice sensor engages the string between the first and second spaced driven rollers. The splice sensor includes a foot with a reflective surface thereon and a transducer positioned to direct a light beam down to the reflective surface and sense the reflected light beam. The foot is positioned such that a splice moving with the loop string will cover the reflective surface and break the light beam, thereby allowing the apparatus to sense the presence of the splice. A measuring transducer is connected to one of the driven rollers and measures the amount of loop string advanced thereby. A cutter apparatus is actuated responsive to the measuring transducer to cut the loop string into sections having the desired length for belt loops and to remove spliced portions from the loop string. Electronic circuitry is employed to regulate the operation of the cutter apparatus.

14 Claims, 7 Drawing Figures

FIG. 3
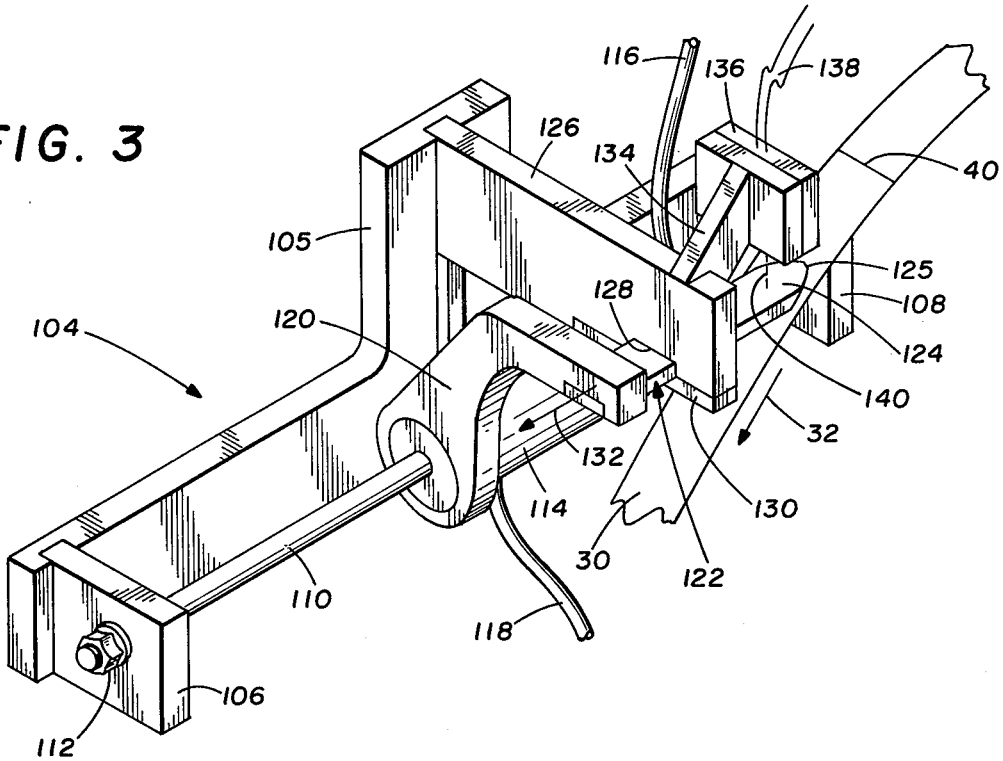
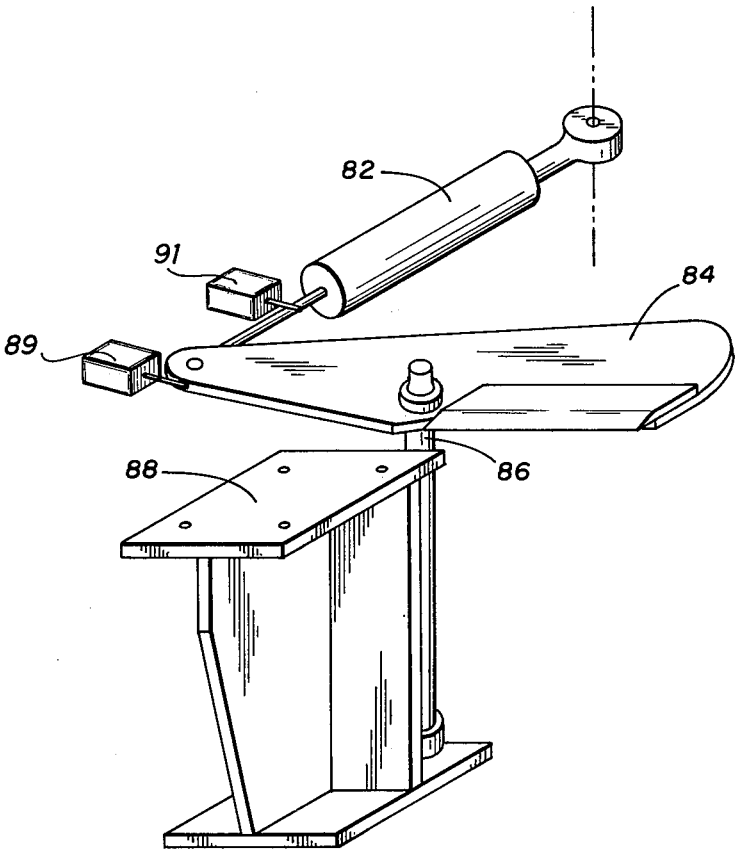
FIG. 5

BELT LOOP TRIMMING APPARATUS

BACKGROUND AND SUMMARY OF THE INVENTION

The present invention relates to improvements in apparatus for making belt loops, and more particularly, to an improved apparatus for automatically cutting the belt loop material in preselected lengths and for locating and removing splices in the belt loop material.

In the manufacture of trousers and similar garments, belt loops are frequently provided at spaced intervals around the waist band of the garment. Typically, belt loops are formed on a length of interfacing material with scrap cloth matching the trousers wrapped thereabout. The cloth is attached to the interfacing either by adhesive or by sewing. The interfacing is supplied in continuous lengths and shorter lengths of cloth are wrapped and attached thereto to form "loop strings". It is apparent that numerous splices will be present along the length of the loop string where pieces of the cloth material abut. The individual belt loops can be, for example, up to 1¼ inches wide, cut into lengths of from about 1 to about 3 inches. The individual loops are cut from the loop string and the splices are removed and discarded.

The apparatus heretofore most often utilized in carrying out the cutting of the individual belt loop lengths from the loop string includes a cutter adapted to cut the loop string into predetermined lengths. Segments having splices therein are manually sorted from the belt loop lengths and discarded. It will be appreciated that during this process, substantial amounts of labor are involved.

The present invention overcomes the foregoing and other problems long since associated with the prior art to provide an apparatus which automatically cuts the loop string into predetermined lengths and removes and discards the splices from the loop string.

In accordance with a more specific aspect of the invention, the apparatus comprises an input portion which directs the loop string into a metering and trimming portion. The metering and trimming portion automatically cuts the loop string to a predetermined belt loop length and locates and removes the splices from the loop string.

According to one embodiment of the invention, a belt loop trimming apparatus is provided having an input portion and a metering and trim portion. The input portion has rollers which engage an incoming continuous loop string. A dancer roller is mounted to form a vertical loop in the string to store material for the metering and trim portion. The loop string enters the metering and trim portion where it consecutively engages and is fed by a pair of vertically spaced driven rollers. The spaced rollers are commonly driven by a motor through a clutch/brake. An idler roller compresses the loop string against the second driven roller to positively move the loop string. A rotary encoder connected to the second driven roller operates through electronic circuitry to control the operation of a cutter to sever the loop string into belt loop lengths. A movable plate deflects the belt loop lengths into a container.

A splice sensor is positioned between two driven rollers to sense the presence of splices in the loop string material and in turn operate the cutter and plate to cut the splices from the string and sort the splices from the belt loop lengths. The loop sensor has a movable foot which contacts the loop string. The foot has a reflective surface adjacent one end positioned to extend under the material of the splices. A lamp/photosensor directs a beam of light onto and receives light reflected from the reflective surface. The presence of a splice is sensed by interrupting the beam of light when the reflective surface of the foot extends under the splice. A pneumatic cylinder is connected to the foot to retract the foot from under the splice material.

DESCRIPTION OF THE DRAWINGS

A more complete understanding of the invention can be had by referring to the following detailed description when taken in conjunction with the accompanying Drawings, wherein:

FIG. 3 is an enlarged perspective view of the splice sensing portion of the improved apparatus of the present invention;

FIG. 5 is an enlarged perspective view of the cutting portion of the present invention for shearing the loop string;

DETAILED DESCRIPTION

Figures 1, 4:
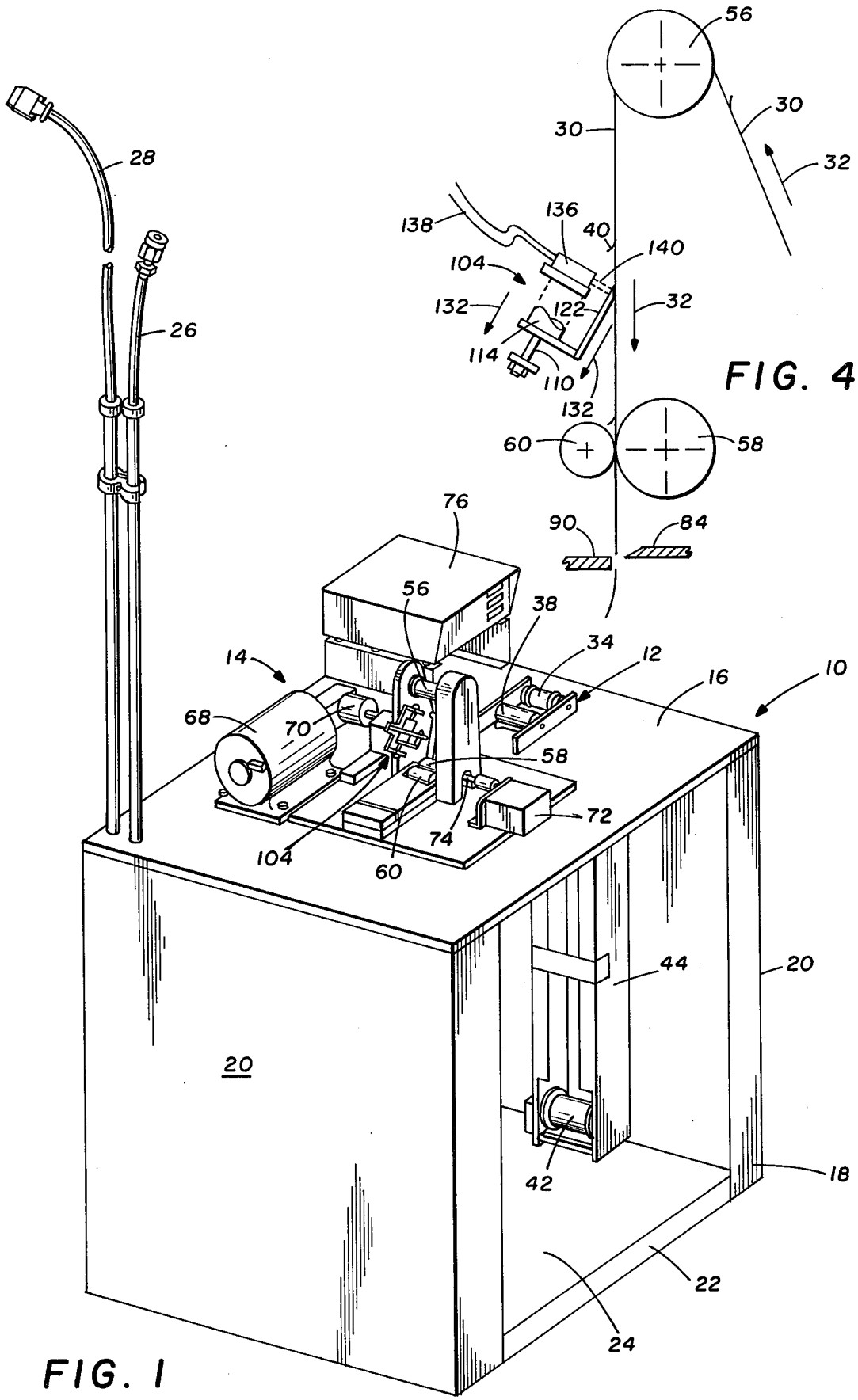
FIG. 1 is a perspective view of the improved apparatus of the present invention.
FIG. 4 is a schematic view showing the splice sensing portion of the apparatus of the present invention positioned adjacent to a loop string.

Referring now to the Drawings wherein like reference characters designate like or corresponding parts throughout the several views, there is illustrated in FIG. 1, an improved belt loop cutting apparatus which, for purposes of description, is identified generally by reference numeral 10. The apparatus 10 is used in the manufacture of belt loops used on trousers, and the like. The apparatus 10 is designed to receive a continuous length of loop string and to feed the loop string into a metering and trimming portion which cuts the loop string into preselected length for manufacturing belt loops and locates and removes the splices from the loop string.

The apparatus 10 has an input portion 12, and a measuring and trimming portion 14 supported from a horizontal surface 16 of a frame 18. The frame 18 has sides 20 and bottom 22 which define an enclosure below the surface 16. To operate the device, pneumatic supply line 26 is connected to a suitable source of pressurized air. Electrical cable 28 is provided for a connection to a suitable supply of electrical power.

Figure 2:
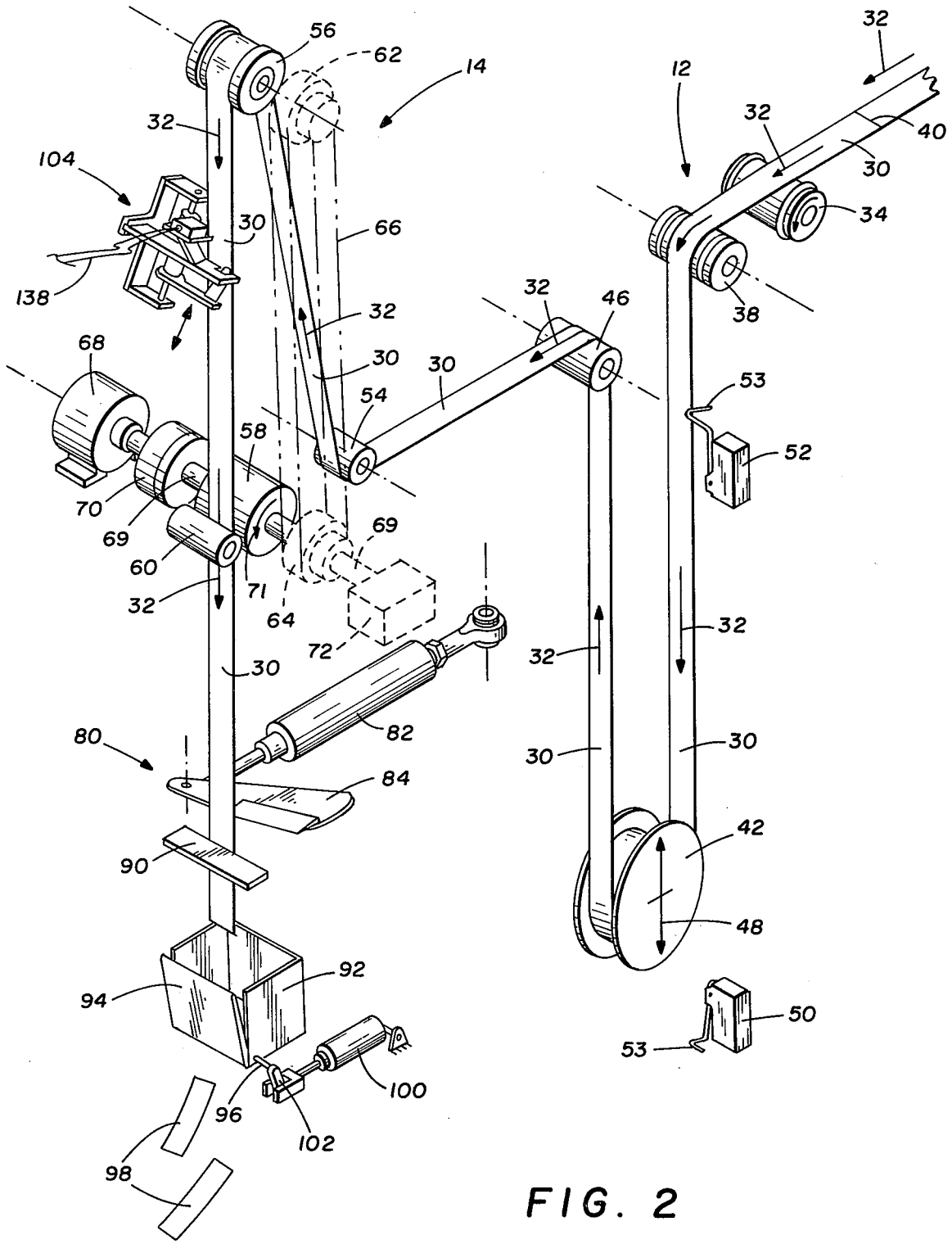
FIG. 2 is an exploded perspective view of the loop string feeding, metering and trimming portions of the improved apparatus of the present invention.

As shown in FIGS. 1 and 2, the loop string 30 enters the input portion 12, and moves through the apparatus in the direction of arrows 32. The loop string 30 enters the apparatus 10 in a horizontally extending direction. The string 30 then passes over a first idler roller 34 and over a second idler roller 38. The rollers 34 and 38 are each mounted to rotate about horizontal, parallel spaced axes.

It is to be noted at this point that the loop string 30 entering the apparatus is in the form of a continuous length of backing material about which has been fastened a fabric material matching the material of the trousers on which the belt loops are to be used. The covering material for the backing is made from scrap clippings resulting from trimming the other parts of the trousers and thus, spaced splices 40 are present in the loop string 30.

After the loop string 30 passes over the roller 38, it extends in a downward vertical direction as can be seen in FIG. 2. String 30 then passes around a dancer roller 42. Dancer roller 42 is constrained in a frame 44. Frame 44 forms a track for the roller 42 allowing it to move vertically up and down the frame 44. The frame 44 and dancer roller 42 are mounted in the enclosure 24 of the apparatus 10. String 30, after passing around the dancer roller 42, extends vertically upward parallel to the leg extending down to the dancer roller 42 and passes over a roller 46. It thus can be seen that a loop is formed in the loop string 30 between the rollers 46 and 38 with the dancer roller 42 supported by the loop string 30 at the bottom of the loop. In view of the freedom of movement of the dancer roller 42 in the vertical direction as illustrated by arrows 48, the amount of material stored in the loop can vary depending on the vertical position of the dancer roller. A pair of limit switches 50 and 52 are positioned at desired upper and lower positions of travel of the dancer roller 42. The actuator arms 53 of these limit switches 50 and 52 are engaged by the dancer roller 42 to open or close the respective switch as desired. In this manner, the amount of material contained in the loop can be sensed and controlled. For example, when the dancer roller 42 moves up to and actuates limit switch 52, the apparatus can be disengaged to prevent any additional material from being discharged from the storage loop. The apparatus can remain disengaged until more material is fed into the apparatus 10 until the dancer roller 42 moves down and actuates the limit switch 50 to reengage the apparatus.

After the loop string passes over the roller 46, it extends horizontally to a roller 54. After passing the roller 54, loop string 30 extends in an upward direction to contact a top driven roller 56 of the metering and trim portion.

After passing the first driven roller 56, the loop string extends in a vertically downward direction and contacts a second driven roller 58 and is resiliently held thereagainst by an idler roller 60. Loop string 30 then extends in a vertically downward direction through a cutting station which will be hereinafter described in detail.

A sprocket 62 is provided on the shaft of roller 56 and a sprocket 64 is provided on the shaft of roller 58. An endless toothed belt 66 engages the sprockets 62 and 64 to connect rollers 56 and 58 together.

The shaft 69 of roller 58 is rotated by means of a motor 68. A clutch/brake 70 couples motor 68 to shaft 69. The clutch/brake 70 can be selectively actuated to connect and disconnect the motor 68 from the roller 58, or to prevent rotation of the roller 58. Thus, when the motor 68 and the clutch of the clutch/brake 70 are engaged, the first and second driven rollers 56 and 58 are rotated in the direction of the arrow 71. Conversely, when the clutch of the clutch/ brake 70 is disengaged and the brake thereof is engaged, the roller 58 is locked in position.

A rotary encoder 72 is coupled to the shaft 69 and generates electrical pulses in proportion of the rotation of the roller 58. As will be hereinafter described in detail, the pulses are utilized to measure the advancement of the loop string 30 through the apparatus. Rotary encoder 72 is electrically connected to a control unit 76.

Positioned below roller 58 and adjacent to the path of the loop string 30, is a cutting station 80. Cutting station 80 operates to cut the loop string 30 into sections of desired length for formation of belt loops. The cutting station 80 comprises a cutter which is shown in detail in FIG. 5. The cutter has a pneumatic actuator cylinder 82 coupled between the frame 18 and a movable knife blade 84. The knife blade 84 is in turn attached to a shaft 86 rotatably affixed to a bracket 88 on frame 18. A fixed knife blade 90 is positioned on the opposite side of the loop string 30. The fixed blade 90 cooperates with the movable knife blade 84 to shear the loop string into belt loop lengths as the cutter actuator cylinder 82 is operated.

Limit switches 89 and 91 are mounted adjacent to the movable knife blade 84. Switch 89 is closed whenever blade 84 is fully retracted. Switch 91 is closed whenever blade 84 is fully advanced.

A guide chute 92 is positioned below the cutting station 80 to receive the cut loop string sections therein. Chute 92 communicates with a receptacle for retaining the belt loop lengths. A sorter mechanism is provided in chute 92 and consists of a deflector plate or dump gate 94 which is pivotally affixed to the chute 92 by means of a horizontal shaft 96. Plate 94 is movable between a first position shown in FIG. 2, wherein the belt loop lengths fall down through the guide chute 92 and a second position wherein the deflector plate 94 completely covers the opening of the guide chute 92 and deflects material to outside of the chute 92 to position 98.

The deflector plate 94 is operated by means of an actuator cylinder 100 coupled to a crank arm 102 on the shaft 96. The other end of the cylinder 100 is coupled to the frame. This sorter is provided to allow the properly cut portions of loop string to fall down the guide chute 92, and when actuated, will sort the spliced portions of the loop string out of the guide chute.

Positioned between the first driven roller 56 and the second driven roller 58 is a splice sensor assembly 104. The splice sensor assembly 104 is illustrated in detail in FIG. 3. This assembly is positioned between the driven rollers 56 and 58 and contacts the loop string 30 to sense the presence of splices in the loop string. The assembly 104 has a frame 105 which is attached to the frame 18 of the apparatus. A pair of parallel brackets 106 and 108 extend transversely from a frame 105. A piston rod 110 spans the distance between the brackets 106 and 108 and is rigidly connected thereto by fasteners 112. A double-acting pneumatic cylinder 114 is mounted on the rod 110 and surrounds a piston (not shown) on the rod 110. The entrance and exit points of the rod 110 from the cylinder 114 are sealed to form two variable volume chambers therein on either side of the piston. It is to be understood, of course, that by suitably controlling the supply of pnematic fluid by conduits 116 and 118 into the variable volume chambers of the cylinder that the cylinder 114 can be caused to axially reciprocate along the length of the rod 110.

A bracket 120 extends from one end of the cylinder 114 and has a foot 122 mounted thereon to extend in the direction parallel to the length of the rod 110. The foot 122 is provided with a reflective upper surface 124 and has an end 125 positioned adjacent the string 30.

A third bracket 126 is attached to the frame 105 and extends parallel to the brackets 106 and 108. The bracket 126 is slightly offset from the brackets 106 and 108 and is provided with a groove 129 on one side thereof. This groove 128 is positioned and shaped to receive the foot 122 therein and acts as a guide for the foot 122. A closure 130 is fixed across the open face of the groove 128 to retain the foot 122 therein. The groove 128 is of a size to allow the foot 122 to reciprocate therethrough in the forward and reverse direction of arrow 132.

A support 134 extends from the bracket 126 and supports lamp/photosensor 136 thereon. The lamp/-photosensor 136 is electrically connected by cable 138 to the control unit 76. A light beam 149 is projected downward onto the reflective surface 124 and is reflected back up to the lamp/photosensor 136. The splices 40 will break or interrupt the reflected beam to the lamp/photosensor 136 and will signal the presence of a splice to the unut.

The operation of the splice sensing assembly 104 will be described by reference to FIGS. 3 and 4. As can be seen in FIG. 4, the loop string 30 has a splice 40 thereon wherein the exterior materials on the loop string terminate and a new portion of material begins. The loop string is moving in the direction of arrow 132 and the leading edge of the trailing portion of the exterior material will slip over the end 125 of foot 122 interrupting the beam 140. This interruption of the beam is sensed by lamp/photosensor 136. This occurrence is conducted to the control unit 76 in the form of an electrical signal which in turn opens suitable valving causing the cylinder 114 to move in a direction of arrow 132 to retract the foot. This retracts the foot from the path of the splice 40, allowing it to pass in the direction of arrow 32 on down between the rollers 58 and 60. This sensing of a splice 40 also initiates a signal which activates the control unit. The control unit 76 thus actuates the cutting station to sever the loop string at a point ⅜ of an inch beyond the splice. In addition, the deflector plate 94 is rotated by cylinder 100 to a position deflecting the spliced portion from the guide chute 92.

Figure 6:
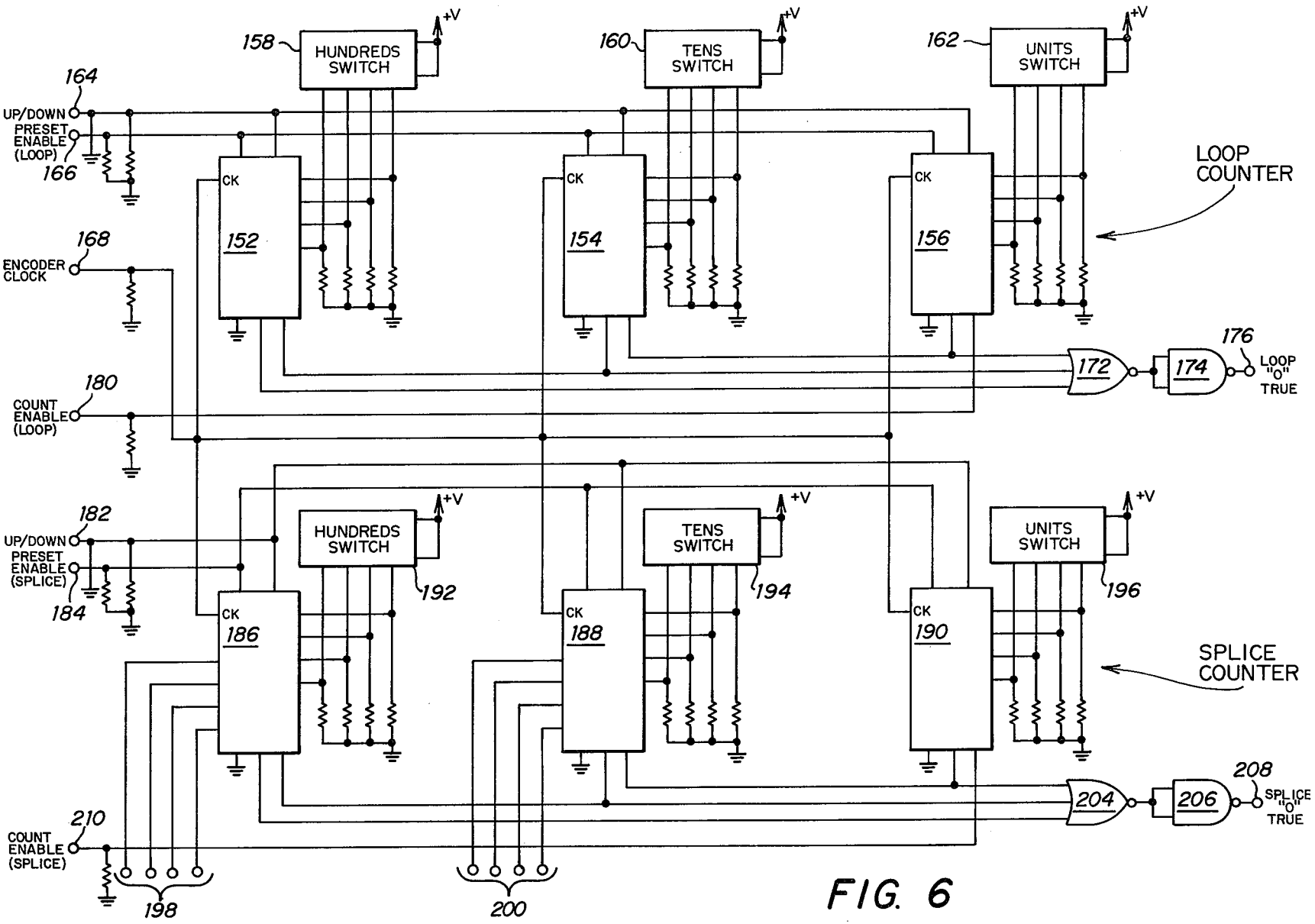
FIG. 6 illustrates a schematic diagram of the counter circuitry of the invention.
Figure 7:
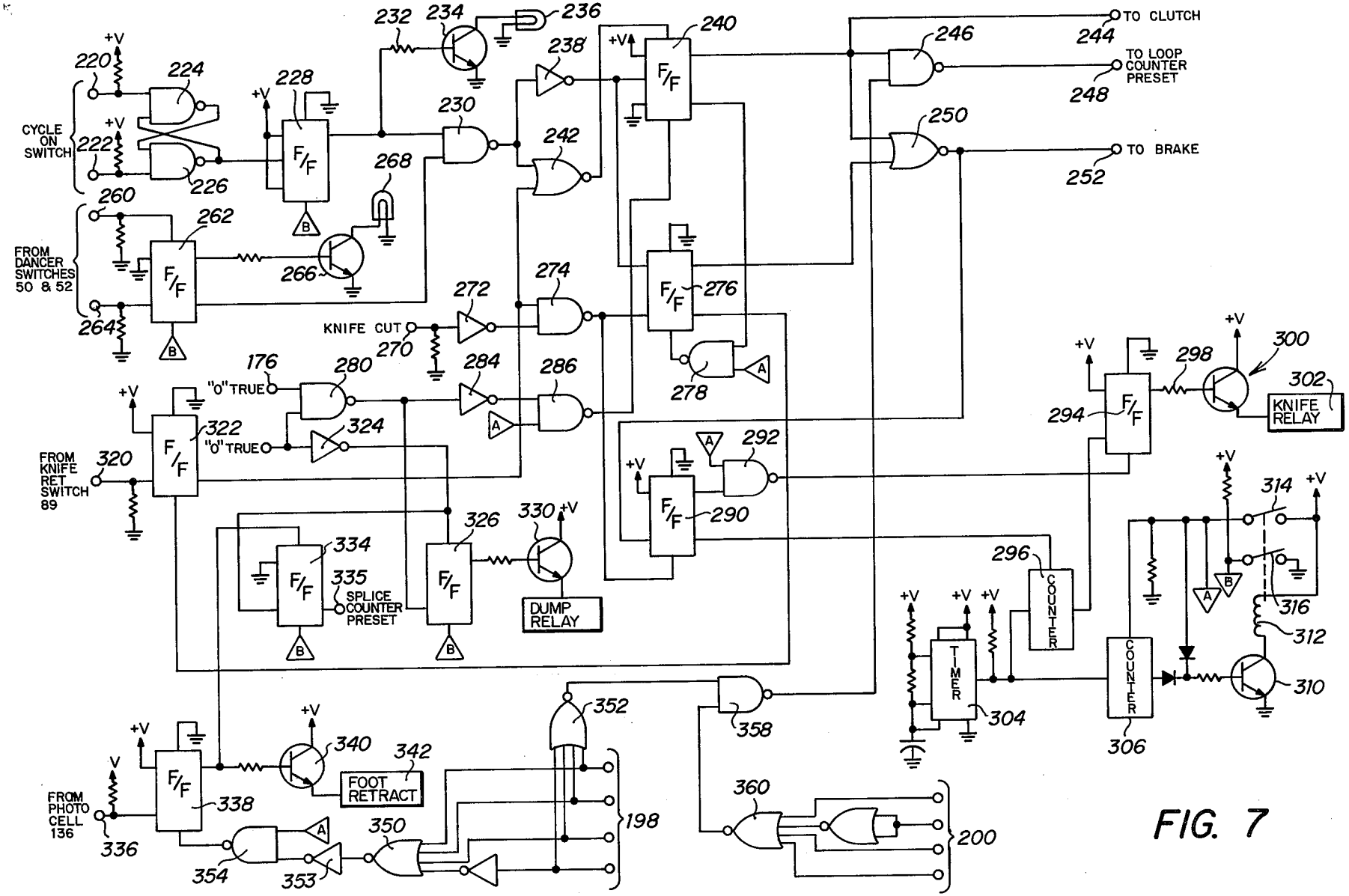
FIG. 7 illustrates a schematic diagram of the logic circuitry of the invention.

FIGS. 6 and 7 illustrate electronic circuitry utilized for the control of the present system. Referring to FIG. 6, the counter circuitry of the invention is shown. It will be understood that conventional driver circuitry and relays interface with the illustrated circuitry and various portions of the system previously identified. Further, it will be understood that conventional power supply circuitry is provided to generate a desirable voltage power source.

Referring to FIG. 6, a Loop Counter includes three binary up/down counters 152, 154 and 156 interconnected in the manner illustrated. Three thumbwheel switches 158, 160 and 162 are interconnected with the inputs of counters 152–156 to enable a desired count to be stored within the counters. The thumbwheel switch 158 includes a rotatable switch having ten positions in order to generate binary signals representative of the hundreds position. Similarly, thumbwheel switch 160 generates binary outputs representative of the tens position, while thumbwheel switch 162 generates binary signals representative of the units position. With the use of the thumbwheel switches 158–162, any number from zero to 999 may be input and stored in the counters 152–156. A suitable type of circuit for use as counters 152–156 may comprise, for example, the CD4029 binary up/down counter. The switches 158–162 thus enable different lengths of belt loop lengths to be cut by the system.

An up/down signal terminal 164 is grounded and is applied to the up/down terminals of the counters 152, 154 and 156 in order to maintain the counters in the count down state. The Loop Preset Enable Signal is applied to terminal 166 from the logic circuitry to be subsequently described to the P terminals of the counters 152, 154 and 156 which comprise the Loop Counter Circuit. An Encoder Clock Signal is applied to terminal 168 from the rotary encoder 72 (FIG.1). This Clock Signal has a frequency depending upon the motor speed of the driver motor and may comprise for example 1080 cps. The Clock Signal is thus representative of the speed of the loop string and the Clock Signal applied to the clock terminals of the counters 152–156. Outputs from the counters 152–156 are applied to a four input NOR gate 172. The output of gate 172 is applied through a dual input NAND gate 174 to supply at terminal 176 the Loop "0" True Signal for application to the logic circuitry to be described in FIG. 7. The Loop Count Enable Signal is applied to terminal 180 and is applied to the CE terminal of counter 156.

The up/down terminal 182 is grounded, while the Splice Preset Enable Signal, derived from the logic circuitry to be described with respect to FIG. 7, is applied to terminal 184. Terminals 182 and 184 are connected to terminals of three binary up/down counters 186, 188 and 190 which comprise the Splice Counter. Thumbwheel switches 192, 194 and 196 are respectively connected to counters 186, 188 and 190 in the manner illustrated, in order to apply bindary signals representative of the setting of the thumbwheel switches into the counter for storage thereby. In this manner, any number fom zero to 999 may be stored within the counters 186, 188 and 190. Thumbwheel switch 192 derives the hundreds position, switch 194 derives the tens position and switch 196 derives the units position of the number stored in the counter. The hundreds count presently stored in counter 186 is applied to terminal 198, while the tens count within counter 188 is applied to terminal 200 for application to the logic circuitry to be described with respect to FIG. 7.

Outputs from the counters 186, 188 and 190 are applied to inputs of a NOR gate 204. The output of gate 204 is applied through a dual input NAND gate 206, the output of which is applied to terminal 208 to provide the Splice "0" True Signal for application to the logic circuitry shown in FIG. 7. The splice count enable signal is applied to terminal 210 and is connected to the CE terminal of counter 190.

FIG. 7 illustrates in schematic detail the logic circuitry of the present invention. A pushbutton Cycle On switch, not shown, is connected across terminals 220 and 222. Depression of the pushbutton switch initiates operation of the cycle and applies proper logic signal to latched NAND gates 224 and 226 to provide switch debouncing. The output of gate 226 is applied to the CK terminal of a flipflop 228, the Q output of which is applied to an input of a NAND gate 230. The Q output of flipflop 228 is also applied through a resistance 232 to the base of a transistor 234. The collector of transistor 234 is connected to a cycle on lamp 236 which is illuminated to indicate the occurrence of an on cycle.

The output of gate 230 is applied through an inverter 238 to the CK input of a flipflop 240. The output of gate 230 is also applied through a NOR gate 242, the output of which is applied to the P terminal of flipflop 240. The Q output of flipflop 240 is applied to terminal 244 which is connected to a switching transistor, not shown, which operates the clutch of the clutch/brake 70 previously described. The Q output of flipflop 240 is also applied to a NAND gate 246 to terminal 248 which generates the Loop Counter Preset Signal applied to terminal 166 in FIG. 6. The Q output of flipflop 240 is also applied to a NOR gate 250, the output of which is applied to terminal 252. Terminal 252 is connected to drive the brake portion of the clutch/brake 70 previously described.

The lower Dancer limit switch 50 (FIG. 2) is connected to terminal 260 which is applied to a D-flipflop 262. The upper Dancer limit switch 52 is applied to terminal 264 which is applied to flipflop 262. The Q output of flipflop 262 is applied to the base of a transistor 266, the collector of which is connected to the Dancer High lamp 268 which is illuminated in order to indicate that the Dancer is in the high position. The $\overline{Q}$ terminal of flipflop 262 is applied to an input of NAND gate 230.

Switch 91 is connected to terminal 270 in order to indicate when the knife has been extended and has cut. Terminal 270 is applied through an inverter 272 to the input of a NAND gate 274. The output of gate 274 is applied to the CK terminal of a D-flipflop 276. Flipflop 276 is interconnected with flipflop 240 and the Q terminal of flipflop 276 is applied as an input to NOR gate 250. The $\overline{Q}$ terminal of flipflop 240 is applied as an input of a NAND gate 278, the output of which is applied to the CL terminal of flipflop 276. An A signal from the initialization circuitry, to be subsequently described, is applied as the second input to gate 278.

The Loop 0 True Signal is applied to terminal 176 from gate 174 (FIG. 6) and is applied as an input to a NAND gate 280. The Splice 0 True Signal is applied to terminal 208 from gate 206 (FIG. 6) and is also applied as an input to gate 280. The output of gate 280 is applied through an inverter 284 to provide an input to a NAND gate 286. The second input to gate 286 comprises an output from the initialization circuitry to be subsequently described. The output of gate 286 is applied to the CL terminal of flipflop 240.

The output of gate 274 is applied to the CL terminal of a D-flipflop 290. The CK terminal of the flipflop 290 is connected to receive the output of NOR gate 250. The Q terminal of flipflop 290 is applied to an input of a NAND gate 292, the output of which is applied to a D-flipflop 294. The $\overline{Q}$ terminal of flipflop 290 is applied to a counter 296, the output of which is applied to clock the flipflop 294. The Q terminal of flipflop 294 is applied through a resistance 298 to a transistor 300. The emitter of transistor 300 is applied to a relay 302 which drives a solenoid to operate a fluid valve, not shown. The fluid valve applies pressure to extend the knife 84 (FIG. 5) to thereby provide cutting action.

A timer 304 is connected to counter 296 and to a second counter 306. The timer may comprise for example an NE555 timer, which during power up or initialization of the circuitry, generates a chain of pulses to the CK terminal of counters 296 and 306. Counter 306 counts from zero to nine in response therto, and at the occurrence of a nine count, generates an output through a resistor 308 to drive a transistor 310 to the conductive state. This causes energization of a relay coil 312 which closes normally open relay contacts 314 and 316. Closing of the relay contacts causes positive bias voltage to be applied to counter 306 to maintain the counter on. Closing of the relay contacts applies ground to terminal B which is applied to each flipflop of the circuit. This applies a reset condition to all of the flipflops to place the flipflops in the correct state for operation of the system. The circuitry comprising the timer 304 and the counter 306 and associated circuitry thus comprises an initialization for proper operation of the system upon start-up.

The switch 89 (FIG. 5) which detects the return of the knife is connected to terminal 320 which is applied to the CK terminal of a D-flipflop 322. The $\overline{Q}$ output of flipflop 322 is applied as inputs to gates 242 and 274. The CL terminal of flipflop 322 is connected to the $\overline{Q}$ terminal of flipflop 276. The Splice Counter 0 True Signal is applied from the counter circuitry shown in FIG. 6 to terminal 208 and through an inverter 324 to a D-flipflop 326. The Q terminal of flipflop 326 is applied to the base of a transistor 330, the emitter of which is connected to control a relay 332 which controls the operation of the Dump gate 94 (FIG. 2).

The output of inverter 324 is also applied to a D-flipflop 334, the $\overline{Q}$ terminal of which generates the Splice Counter Preset Signal which is applied to terminal 184 of the circuitry shown in FIG. 6.

The output fom the photocell 136 (FIG. 3), which detects the occurrence of a splice, is applied to terminal 336 and to a D-flipflop 338. The Q terminal of flipflop 338 is applied to flipflop 334 and is also applied to the base of a transistor 340. The emitter of transistor 340 controls a relay 342 which operates the solenoid to operate a hydraulic cylinder (not shown) in order to retract the foot 122 as previously described.

The binary outputs appearing at terminal 198 from the hundreds counter 186 from the splice counter shown in FIG. 6 are applied to inputs of four input NOR gates 350 and 352 for decoding. The output of gate 350 is applied through an inverter 353 to an input of a NAND gate 354. The output of gate 354 is applied to the clear terminal of flipflop 338. The output of NOR gate 352 is applied to an input of a NAND gate 358, the output of which is applied as an input to gate 246. The binary outputs appearing at terminals 200 from the tens counter 188 of the Splice Counter are applied to the inputs of a four input NOR gate 360. The output of gate 360 is applied as an input to gate 358.

OPERATION OF THE DEVICE

A more detailed understanding of the present invention can be obtained from a description of the operation of the device by reference to FIG. 2.

First, the input portion 12 operates to receive the loop string 30 and insures that a sufficient amount of loop string is present in the apparatus for proper operation of the metering and trim portions 14. The loop string 30 is fed over rollers 34 and 38 and a storage loop is formed between roller 38 and 46 by dancer roller 42. Dancer roller 42 is free to move vertically in a frame and will contact the actuator arms 53 of limit switches 50 and 52. Feed limit switches 50 and 52 are connected to the control unit 76. When sufficient loop string is not stored in the feed section, the dancer roller 42 will be caused to move up and close limit switch 52. This is transmitted to the control unit 76, in turn, disengages the metering and trim portion 14. The metering and trim portion 14 will remain disengaged until sufficient loop string 30 is fed into the input portion. As string 30 is fed into the feed portion, dancer roller 42 moves in the downward direction to close switch 50. This operation of switch 50 is communicated to the control unit 76 which re-initiates operation of the metering and trim portion 14.

The loop string 30 leaves the feed portion 12 and enters the metering and trim portion by passing over the first driven roller 56. The loop string 30 passes between the second driven roller 58 and an idler roller 60. Rotary encoder 72 is connected to the control unit 76 which operates the cutter 80 to cut the desired section lengths of the belt loop material. These belt loop lengths then fall through the guide chute 92 and are held in the receptacle (not shown).

Upon appearance of a splice 40 in the metering and trim portion, the leading edge of the following portion of the cover material of the splice will extend over the foot 122 and interrupt the light beam 140. Interruption of the light beam then actuates the lamp/photosensor 136 which is in turn connected to the control unit 76. The pneumatic cylinder 114 is operated to retract the foot 122 from the splice 40. The control unit 76 is energized and will operate the cutting station 80 upon movement of the splice 40⅜ of an inch beyond the cutting station. In this regard, the distance between the splice sensing assembly 104 and cutter assembly is known and the output of the rotary encoder 72 is employed to determine that length plus ⅜ of an inch. Simultaneously, with the actuation of the cutter to cut the splice from the loop string, the deflector plate 94 is moved by cylinder 100 to deflect the splice from the guide chute.

The operation of the electrical portion of the system shown in FIGS. 6 and 7 may be best understood by reference to the following table illustrating the respective states of the brake/clutch, knife and dancer previously described.

TABLE I

| | LOOP SEQUENCE | | | | | |
|---|---|---|---|---|---|---|
| | Brake | Clutch | Knife | Cycle | | Dancer |
| Power On | 1 | 0 | *1 | 0 | | $0_1$ |
| Knife Cut | 1 | 0 | 0 | 0 | | 0 |
| Knife Ret. | 1 | 0 | 0 | 0 | | 0 |
| Cycle On | 0 | 1 | 0 | 1 | | 0 |
| "0" True | 1 | 0 | *1 | 1 | | 0 |
| Knife Cut | 0 | 0 | 0 | 1 | | 0 |
| Knife Ret. | 0 | 1 | 0 | 1 | | 0 |
| "0" True | 1 | 0 | *1 | 1 | | 0 |
| Knife Cut | 0 | 0 | 0 | 1 | | 0 |
| Knife Ret. | 0 | 1 | 0 | 1 | | 0 |
| . | | | | | | |
| . | | | | | | |
| "0" True | 1 | 0 | *1 | 1 | | 0 |
| Knife Cut | 0 | 0 | 0 | 1 | | 0 |
| Knife Ret. | 0 | 1 | 0 | 1 | | 0 |
| Cycle off | 0 | 1 | 0 | 0 | or | 1 |
| Dancer High | | | | | | |
| "0" True | 1 | 0 | *1 | 0 | or | 1 |

TABLE I-continued

| | LOOP SEQUENCE | | | | | |
|---|---|---|---|---|---|---|
| | Brake | Clutch | Knife | Cycle | | Dancer |
| Knife Cut | 1 | 0 | 0 | 0 | or | 1 |
| Knife Ret. | 1 | 0 | 0 | 0 | or | 1 |

* = 500 millisecond delayed
$0_1$ = Dancer Low
1 = Dancer High

TABLE II

| | SPLICE SEQUENCE | | | | |
|---|---|---|---|---|---|
| | Brake | Clutch | Knife | Retract | Dump |
| Photo Cell | X | X | X | 1 | 0 |
| "200" True | 0 | 1 | 0 | 0 | 0 |
| "0" True | 1 | 0 | *1 | 0 | 1 |
| Knife Cut | 0 | 0 | 0 | 0 | 1 |
| Knife Ret. | 0 | 1 | 0 | 0 | 1 |
| . | | | | | |
| . | | | | | |
| Photo Cell | X | X | X | 1 | 0 |
| "200" True | 0 | 1 | 0 | 0 | 0 |
| "0" True | 1 | 0 | *1 | 0 | 1 |
| Knife Cut | 0 | 0 | 0 | 0 | 1 |
| Knife Ret. | 0 | 1 | 0 | 0 | 1 |

X = State Determined by Loop Sequence

In initial operation of the system, the loop counter thumbwheel switches 158–162 are manually operated in order to be set with the desired number to determine the belt loop length. In addition, the splice counter thumbwheel switches 192–196 are set with a number to cut splices in the desired manner. At start-up of the system, the initialization circuitry shown in FIG. 7 is utilized in order to set the circuitry at the desired states. Upon powering up of the system, the timer 304 generates a chain of pulses which is applied to counter 306. Counter 306 counts up to the count of nine, and then outputs a signal through resistance 308 to render transistor 310 conductive. This causes relay 312 to be actuated in order to close contacts 314 and 316. This applies bias voltage to hold the counter 306 on and applies ground to contact B. Contact B is applied to the clear terminals of each flipflop in the circuitry shown in FIG. 7 in order to clear the flipflops and place them at the correct states for operation.

LOOP SEQUENCE OPERATION

When power is initially applied to the system, it is desired that the brake 70 (FIG. 2) be on, with the knife 84 (FIG. 2) placed in the extended position. Thus, the output of gate 250 (FIG. 7) is high and the brake is energized. This initial state is illustrated in Table I, in that upon the power on state, the brake is actuated and the knife is extended, while the clutch, cycle and dancer are not energized. When the knife 84 is extended, the limit switch 91 is actuated, thereby applying a signal to terminal 270 and to flipflop 276.

The $\overline{Q}$ output of flipflop 276 then applies a clear signal to flipflop 322. A clear signal is also applied from gate 274 to flipflop 290, which operates to clear flipflop 294 and to de-energize relay 302 to retract the knife 84. The extension and retraction of the knife is illustrated as the second and third steps of the Loop Sequence shown in Table I. This power on operation provides a reference point on the loop to enable initial accurate operation.

When it is desired to initiate a loop cycle, the cycle start button is manually depressed and logic conditions are applied to terminals 220 and 222 of FIG. 7 to operate the latch comprised of gates 224 and 226 in order to toggle flipflip 228 to initiate the cycle on state. In this state, the lamp 236 is illuminated, the clutch is turned on and the brake is turned off. The cycle continues in the manner to be subsequently described until the cycle off signal is detected or until the dancer goes high.

When the clutch is turned on, the feed roller is allowed to rotate in order to drive the loop 30 through the machine. This causes the encoder 72 to generate pulses which are applied to terminal 168 of FIG. 6. These pulses operate to clock the counters 152–156 of the Loop Counter. The Loop Counter then counts down, beginning at the preselected number entered by the thumbwheel switches 158–162, as long as the preset enable signal applied to terminal 166 is high. When the counters 152, 154 and 156 count to zero, a true signal is applied at terminal 176 of the output of gate 174 to indicate the Loop 0 True Signal. This signal is applied to terminal 176 in order to generate a signal at the output of gate 250 to terminal 252 in order to energize the brake. Simultaneously, the clutch is de-energized and the knife 84, after a 500 millisecond time delay, is energized. This time delay allows the roller to stop moving before the knife cuts. The knife is then extended and cuts the loop. Switch 91 is energized and applies a logic signal to terminal 270. This operates flipflop 276 in order to de-energize the brake.

This logic level also causes flipflop 322 to be cleared and causes the flipflops 290 and 294 to be cleared in order to de-energize relay 302 to retract the knife 84. The knife is then returned, thereby actuating the knife return limit switch 89. This causes the clutch to be turned on in order to drive the roller. These operational states are illustrated in the Table I. The loop is then driven through the machine, causing the encoder to generate additional pulses which clock the counters 152, 154 and 156, which have been reset to the predetermined count. The counters count down from the predetermined count stored therein and the cycle repeats as illustrated in Table I unitl the cycle is turned off or the dancer goes high. The system thus operates in a feed and cut, feed and cut cycle until terminated. It is important to note that when the knife is extended to cut, the brake is on so that the roller will not be accidently turned relative to the knife in order to prevent error upon the next cycle start-up.

When the cycle off button is depressed, logic conditions are applied to terminals 220 and 222 such that the cycle on lamp 236 is de-energized. Logic signals are applied to the loop counter preset in order to prevent further counting by the counters 152, 154 and 156. As shown in Table I, the Loop 0 True Signal is then again generated, causing the knife to be extended. This causes the switch 91 to be actuated, thereby causing the knife to be reacted in order to place the system in position for the next on cycle. As shown in Table I, the same off sequence is provided when the dancer limit switches 50 and 52 are actuated. When the dancer switches are actuated, the dancer lamp 268 is illuminated.

SPLICE SEQUENCE OPERATION

Operation of the system in the splice sequence may be explained by reference to the previously described circuitry in conjunction with Table II. When the system is in the automatic mode, and the photocell 136 (FIG. 3) is covered by a splice in the loop, a signal from the photocell is applied to terminal 336 in FIG. 7. The flipflop 338 is toggled to operate transistor 340 to operate relay 342 in order to retract the foot 122. At this time, the splice preset enable is generated by the flipflop 334 in order to enable the splice counter comprising counters 186, 188 and 190 (FIG. 6). The Encoder clock pulses from encoder 72 are applied to clock the counters 186–190. The splice counter begins to count down and applies binary signals representative of the counter count to terminals 198 and 200. These binary signals are decoded by the gate 350 and 354.

Upon the occurrence of a Receive 200 True Count from the Splice Counter, the flipflop 338 is cleared and the transistor 340 is de-energized and the retract relay 342 is de-energized. The knife 84 is then retracted. At this time, the clutch is applied, as illustrated in the 200 True state in the splice sequence shown in Table II. The counters continue counting until the logic circuitry shown in FIG. 7 decodes a 40 True. This signal is decoded by gates 360 and 358 and is applied to gate 246 to cause the generation of the Loop Counter Preset on terminal 252. This enables indexing of the Loop Counter with the Splice Counter to enable continued loop cutting operation after the splice is removed.

When the splice counter counts to zero, a Splice Counter 0 True is applied from the counter to terminal 208 at the output of gate 206, the brake is energized and the clutch is de-energized. The knife 84, after a 500 millisecond delay, is extended to cut. In addition, the flipflop 326 is toggled to energize transistor 330, which energizes relay 332 in order to operate the dump gate 94 in order to release the scrap portion of the splice. The switch 91 detects the outward extension of the knife 84 and operates to cause the release of the brake and the retraction of the knife. Upon the retraction of the knife, switch 89 is actuated in order to cause the energization of the clutch. The loop is then moved until the photocell 136 is again covered by a splice, at which time the cycle repeats itself in order to cut the splice from the loop. This circuitry thus enables the automatic cutting out of splices with minimum waste. Thumbwheel switches 192–196 may be varied to vary the amount of material cut with each splice.

Thus, it can be seen that an automatic apparatus for cutting lengths from a continuous belt loop material for use in forming belt loops is described. In addition, the apparatus selectively cuts spliced portions from the loop string and sorts the same from the belt loop lengths automatically for later discarding.

It is to be understood, of course, that the foregoing disclosure relates only to one embodiment of the present invention and that numerous alterations can be utilized to practice the present invention without departing from the spirit and scope of the invention as defined in the appended claims.

What is claimed is:

1. An apparatus for forming belt loops from an elongated loop string having a backing material and with shorter lengths of cloth wrapped about the exterior of the backing material and forming splices between adjacent lengths of cloth, the apparatus comprising in combination:

an input portion comprising a dancer roller engaging said loop string, said dancer roller being movably mounted to form a loop in said loop string, an idler roller engaging loop string extending from said dancer roller, means sensing the position of said dancer roller whereby the amount of material stored in said input portion can be regulated; and a metering and trim portion positioned to receive the loop string exiting said input portion and operatively associated with said means for sensing the position of said dancer roller to disengage said metering and trim portion when the amount of loop string stored in said input portion is less than a set minimum, said metering and trim portion having a pair of driven rollers engaging said loop string and being connected together by an endless belt, a tension roller compressing said loop string against the second of said driven rollers, said second driven roller being operatively connected to a metering drive motor through a clutch/brake whereby said metering drive motor may be disconnected from said second driven roller and the rotation of the roller terminated, a rotary encoder connected to said second driven roller to generate pulses as said second driven roller rotates, a cutting apparatus comprising a fixed knife blade adjacent to the path of said loop string and a movable knife blade selectively movable to engage said fixed knife blade and shear said loop string, an actuator cylinder operatively associated with said movable knife blade which, when actuated, moves said knife blade to shear said loop string, said cylinder being operatively associated with said rotary encoder and said clutch/brake to shear said loop string at predetermined lengths required by said belt loops, a foot positioned adjacent the path of said loop string between said first and second driven rollers, a lamp/photosensor positioned adjacent said foot for directing a beam of light onto and for receiving light reflected from the surface of said foot, said foot being positioned so that splices in said loop string will engage said foot and interrupt the light beam, means operatively associated with said lamp/photosensor to retract said foot upon the presence of a splice in said loop string and for operating said cutter actuator cylinder to sever said loop string at a point adjacent the splice in said loop string, and a deflector positioned adjacent said cutter for deflecting and sorting said splices from said precut belt loop lengths.

2. An apparatus for cutting belt loops from an elongated loop string having a material splice therein comprising in combination:

feed means for feeding said loop string through said apparatus;

a cutter positioned adjacent the path of said loop string for selectively cutting said loop string;

means for measuring movement of said loop string through said feed means and for selectively operating said cutter to cut belt loop lengths from said loop string;

means for sensing the position of a splice in said loop string and for operating said cutter to remove the portion of said loop string containing said splice therefrom;

said means for sensing the position of a splice in said loop string comprising:

a foot extending adjacent to the path of the loop string and positioned whereby said foot will extend under the spliced material in said loop string; and a lamp/photosensor means positioned to direct light onto and to receive light reflected from said foot whereby said light path is interrupted when said foot extends under said spliced material.

3. The apparatus of claim 2 additionally comprising a selectively operable deflector means operatively associated with said splice sensing means to sort said belt loop lengths from said removed splice portions.

4. The apparatus of claim 2 wherein said feed means comprises a movable dancer roller for maintaining a predetermined amount of loop string in said feed means, and means for sensing the amount of loop string in said feed means and for selectively disengaging said apparatus when less than a predetermined length of loop string is present in said feed means.

5. The apparatus of claim 2 wherein said means for measuring comprises:

encoder means for generating pulses representative of the movement of said loop string, counter means set at a preset count, means for clocking said counter means with said pulses to cause said counters to count down, and means for operating said cutter upon the occurrence of a predetermined count in said counter.

6. The apparatus of claim 5 and further comprising means for varying said preset count in said counter means.

7. The apparatus of claim 2 wherein said means for sensing the position of a splice and for operating said cutter comprises:

counter means having a preset count set therein, circuitry responsive to sensing of a splice in said loop string for causing said counter means to count downwardly, and means responsive to the occurrence of a predetermined count in said counter means for operating said cutter to remove said splice.

8. An apparatus for cutting belt loops from an elongated loop string having splices therein comprising in combination:

feed means for feeding said loop string through said apparatus;

a cutter positioned adjacent the path of said loop string for selectively cutting sections from said loop string;

means for sensing the position of a splice in said loop string and for operating said cutter to cut the portion of said loop string containing said splice therefrom;

said means for sensing the position of a splice in said loop string comprising:

a foot extending adjacent to the path of the loop string and positioned whereby said foot will extend under the splice of material in said loop string; and a photosensor means positioned to receive light reflected from said foot whereby said light path is interrupted when said splice material contacts said foot.

9. The apparatus of claim 8 additionally comprising a selectively operable deflector means operatively associated with said splice sensing means to deflect said removed splice sections to a receptacle.

10. The apparatus as defined in claim 8 wherein said feed means comprises a movable dancer roller for maintaining a predetermined length of loop string in said feed means, and means for sensing the length of the loop string in said feed means and for selectively disengaging said apparatus when less than a predetermined length of loop string is present in said feed means.

11. The apparatus of claim 8 and further comprising:
counter means having a preset count stored therein,
encoder means for generating pulses representative of the movement of said loop string,
means for clocking said counter means with said pulses to cause said counter means to count downwardly, and
means responsive to the occurrence of a predetermined count in said counter means for operating said cutter.

12. The apparatus of claim 8 and further comprising:
brake means operable to stop movement of said loop string prior to operation of said cutter.

13. An apparatus for cutting belt loops from an elongated loop string comprising:
feed means for feeding said loop string along a prescribed path,
a cutter disposed adjacent said path for selectively cutting said loop string,
encoder means for generating pulses representative of the movement of said loop string along said path,
a loop counter containing a preset count and responsive to said pulses for counting,
circuitry responsive to a predetermined count within said loop counter for operating said cutter to cut a belt loop having a prescribed length,
means for sensing a material splice in said loop string,
a splice counter containing a preset count and responsive to said pulses for counting, said preset count beginning with the sensing of the material splice and ending with a predetermined count,
circuitry responsive to said predetermined count within said splice counter for operating said cutter to cut said material splice from said loop string,
circuitry responsive to a second predetermined count in said splice counter for resetting said loop counter in order to index said apparatus for proper cutting of additional belt loops.

14. A splice sensor apparatus for locating splices in the covering material of an elongated moving loop string, the apparatus comprising:
a frame mounted to extend adjacent to the loop string,
a foot movably mounted on said frame, an extending portion on said foot for contacting the string,
a reflective surface formed on said extending portion,
a lamp/photosensor means for directing a beam of light onto said reflective surface and for receiving light reflected from said surface and thereby sensing the interruption of said beam of light by the material of said splice, and
means for selectively moving said foot away from the string.

* * * * *